United States Patent [19]

Nakazawa

[11] 4,419,429

[45] Dec. 6, 1983

[54] SENSITIZED ELECTROPHOTOGRAPHIC PHOTOSENSITIVE COMPOSITION

[75] Inventor: Toru Nakazawa, Sennan, Japan

[73] Assignee: Mita Industrial Co., Ltd., Osaka, Japan

[21] Appl. No.: 346,774

[22] Filed: Feb. 8, 1982

[30] Foreign Application Priority Data

Feb. 9, 1981 [JP] Japan ..... 56-16823

[51] Int. Cl.[3] ..... G03G 5/06; G03G 5/09

[52] U.S. Cl. ..... 430/83

[58] Field of Search ..... 430/81, 83

[56] References Cited

U.S. PATENT DOCUMENTS 3,287,119 11/1966 Hoegl ..... 430/81 X 4,302,521 11/1981 Takei et al. ..... 430/81 X

FOREIGN PATENT DOCUMENTS 9742 4/1980 European Pat. Off. ..... 430/83

44-14875 7/1969 Japan ..... 430/83

OTHER PUBLICATIONS

Meier et al., "Doping Organic Photoconductors", Zeit. Phys. Chem., N. F., 39, pp. 249–261 (1963).

Kearns et al., "Electrical Properties of Organic Solids", Jour. Chem. Phys., vol. 32, No. 4, pp. 1020–1025, (Apr., 1969).

*Primary Examiner*—Roland E. Martin, Jr.

*Attorney, Agent, or Firm*—Sherman & Shalloway

[57] ABSTRACT

Disclosed is an electrophotographic photosensitive composition which comprises a phthalocyanine type photoconductor dispersed in an electrically insulating resin medium, wherein a nitrophthalic anhydride represented by the following formula:

(I)

wherein n is a number of 1 or 2, is incorporated as a sensitizer.

3 Claims, 1 Drawing Figure

SENSITIZED ELECTROPHOTOGRAPHIC PHOTOSENSITIVE COMPOSITION

BACKGROUND OF THE INVENTION (1) Field of the Invention

The present invention relates to a sensitized electrophotographic photosensitive composition. More particularly, the present invention relates to a photosensitive composition comprising a phthalocyanine photoconductor and a resin, which is sensitized by a nitrophthalic anhydride.

(2) Description of the Prior Art

A photosensitive composition comprising a phthalocyanine type photoconductor dispersed in an electrically insulating resin medium is widely used in the field of electrophotography. As the chemical sensitizer for this photosensitive composition, there are known polycyclic and heterocyclic nitro compounds such as trinitroanthrathene and 2,4,7-trinitrofluorenone, acid anhydrides such as phthalic anhydride and trimellitic anhydride, and various electron acceptors such as chloranil and bromanil.

SUMMARY OF THE INVENTION

We found that when a nitrophthalic anhydride, especially 4-nitrophthalic anhydride, is selected among various electron acceptors and is used as a sensitizer for a photosensitive composition comprising a dispersion of a phthalocyanine type photoconductor in a resin, it can exert a much higher sensitizing effect than those of analogous sensitizing compounds.

It is therefore a primary object of the present invention to provide a photosensitive composition for electrophotography which comprises a novel sensitizing agent.

Another object of the present invention is to provide a photosensitive composition comprising a dispersion of a phthalocyanine photoconductor in a resin, which is excellent over known photosensitive compositions in the sensitivity.

Still another object of the present invention is to provide a photosensitive composition which comprises a sensitizing agent which is easily soluble in an organic solvent and hence, is easily dispersible in an electrically insulating or photoconductive resin medium.

More specifically, in accordance with the present invention, there is provided an electrophotographic photosensitive composition which comprises a phthalocyanine type photoconductor dispersed in an electrically insulating resin medium wherein a nitrophthalic anhydride represented by the following formula:

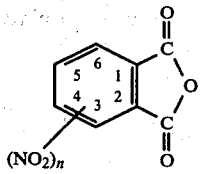

(I)

wherein n is a number of 1 or 2, is incorporated as a sensitizer.

DETAILED DESCRIPTION OF THE PREFERRED EMBODIMENTS

Figure 1:
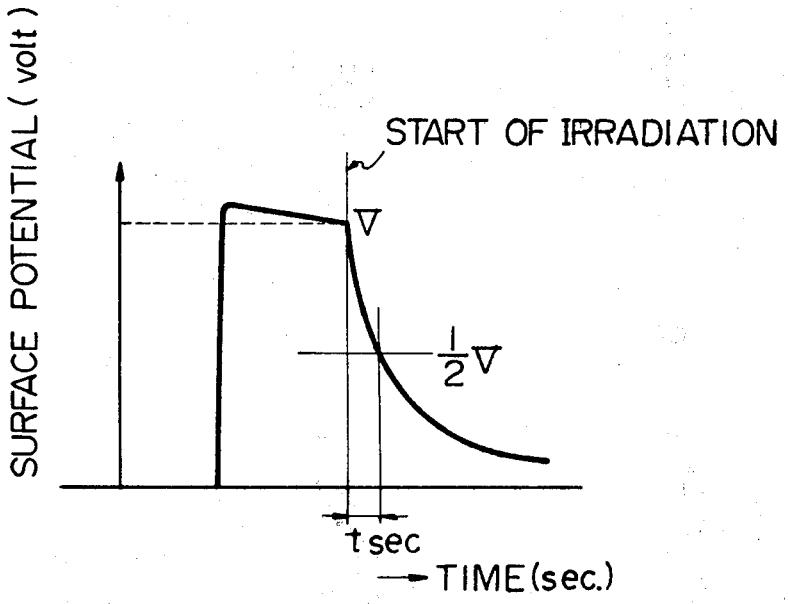
FIG. 1 is a graph illustrating the mode for determining the charge decay characteristic of a photosensitive layer.

According to the present invention, by using a nitrophthalic anhydride represented by the above formula (I), the sensitivity of a phthalocyanine type photoconductor layer can be prominently increased as compared with the sensitivity attained by known sensitizers having an analogous chemical structure. As described in detail hereinafter, the sensitivity of an electrophotographic photosensitive layer is expressed in terms of the exposure quantity (lux.sec) for reducing the surface potential of the photosensitive layer to a half value, and the smaller is this value, the higher is the sensitivity. A known sensitizer most analogous to the nitrophthalic anhydride of the present invention, for example, phthalic anhydride, has no substantially appreciable sensitizing effect to a metal-free phthalocyanine/polyester resin system (see Comparative Example 4 given hereinafter). In contrast, if the above-mentioned nitrophthalic anhydride is used according to the present invention, the sensitivity is increased to a level about 6 times as high as the sensitivity attained by the known sensitizing agent. Moreover, the sensitivity attained by this nitrophthalic anhydride is about 2 times as high as the sensitivity attained by 2,4,7-trinitro-9-fluorenone (Comparative Example 2 given hereinafter) which has the highest sensitizing effect among polycyclic and heterocyclic nitro compound type sensitizers. In the present invention, it is important that the sensitizer used should be in the form of an acid anhydride. For example, 4-nitrophthalic acid has substantially no appreciable sensitizing effect (see Comparative Example 5 given hereinafter).

As preferred examples of the nitrophthalic anhydride represented by the above formula (I), there can be mentioned 3-nitrophthalic anhydride, 4-nitrophthalic anhydride, 3,5-dinitrophthalic anhydride and 3,6-dinitrophthalic anhydride. Among these nitrophthalic anhydrides, 4-nitrophthalic anhydride is most preferred. These nitrophthalic anhydrides may be used singly or in the form of a mixture of two or more of them or a mixture with a sensitizing agent consisting of other known electron acceptors.

All the known phthalocyanines and their derivatives having a photoconductivity can be used as the phthalocyanine photoconductor in the present invention. As preferred examples, there can be mentioned aluminum phthalocyanine, aluminum polychlorophthalocyanine, antimony phthalocyanine, barium phthalocyanine, beryllium phthalocyanine, cadmium hexadecachlorophthalocyanine, cadmium phthalocyanine, cerium phthalocyanine, chromium phthalocyanine, cobalt phthalocyanine, cobalt chlorophthalocyanine, copper 4-aminophthalocyanine, copper bromochlorophthalocyanine, copper 4-chlorophthalocyanine, copper 4-nitrophthalocyanine, copper phthalocyanine sulfonate, copper polychlorophthalocyanine, duteriophthalocyanine, dysprosium phthalocyanine, erbium phthalocyanine, europium phthalocyanine, gadolinium phthalocyanine, gallium phthalocyanine, germanium phthalocyanine, holmium phthalocyanine, indium phthalocyanine, iron phthalocyanine, iron polyhalophthalocyanine, lanthanum phthalocyanine, lead phthalocyanine, lead polychlorophthalocyanine, cobalt hexaphenylphthalocyanine, copper pentaphenylphthalocyanine, lithium phthalocyanine, lutetium phthalocyanine, magnesium phthalocyanine, manganese phthalocyanine, mercury phthalocyanine, molybdenum phthalocyanine, naphthalocyanine, neodium phthalocyanine, nickel phthalocyanine, nickel polyhalophthalocyanine, osmium phthalocyanine, palladium phthalocyanine, palladium chlorophthalocyanine, alkoxyphthalocyanine, alkylaminophthalocyanine, alkylmercaptophthalocyanine, arylaminophthalocyanine, aryloxyphthalocyanine, arylmercaptophthalocyanine, copper phthalocyanine piperidine, cycloalkylaminophthalocyanine, dialkylaminophthalocyanine, diaralkylaminophthalocyanine, dicycloalkylaminophthalocyanine, hexadecahydrophthalocyanine, imidomethylphthalocyanine, 1,2-naphthalocyanine, 2,3-naphthalocyanine, octa-azophthalocyanine, sulfur phthalocyanine, tetra-azophthalocyanine, tetra-4-acetylaminophthalocyanine, tetra-4-aminobenzoylphthalocyanine, tetra-4-aminophthalocyanine, tetrachloromethylphthalocyanine, tetradiazophthalocyanine, tetra-4,4-dimethylocta-azophthalocyanine, tetra-4,5-diphenylenedioxide-phthalocyanine, tetra-4,5-diphenylocta-azophthalocyanine, tetra-(6-methylbenzothiazoyl)phthalocyanine, tetra-p-methylphenylaminophthalocyanine, tetramethylphthalocyanine, tetranaphtotriazolphthalocyanine, tetra-4-naphthylphthalocyanine, tetra-4-nitrophthalocyanine, tetraperinaphthylene-4,5-octa-azophthalocyanine, tetra-2,3-phenylene-oxidephthalocyanine, tetra-4-phenylocta-azophthalocyanine, tetraphenylphthalocyanine-tetra-carboxylic acid, tetraphenylphthalocyanine tetrabarium carboxylate, tetraphenylphthalocyanine, tetra-4-trifluoromethylmercaptophthalocyanine, tetrapyridylphthalocyanine, tetra-4-trifluoromethylmercaptophthalocyanine, tetra-4-trifluoromethylphthalocyanine, 4,5-thionaphthene-octa-azophthalocyanine, platinum phthalocyanine, potassium phthalocyanine, rhodium phthalocyanine, samarium phthalocyanine, silver phthalocyanine, silicon phthalocyanine, sodium phthalocyanine, sulfonic phthalocyanine, thorium phthalocyanine, thulium phthalocyanine, tin chlorophthalocyanine, tin phthalocyanine, titanium phthalocyanine, uranium phthalocyanine, vanadium phthalocyanine, ytterium phthalocyanine, zinc chlorophthalocyanine, zinc phthalocyanine, and dimers, trimers, oligomers, homopolymers and copolymers thereof.

As the phthalocyanine or its derivative that is easily available and is especially suitable for attaining the objects of the present invention, there can be mentioned a metal-free phthalocyanine and its nucleus-substituted derivative such as a nucleus-halogen-substituted derivative.

All of known electrically insulating, thermoplastic and thermosetting resin binders can be used as the electrically insulating resin medium in the present invention. As preferred binders, there can be mentioned thermoplastic binders such as saturated polyester resins, polyamide resins, acrylic resins, ethylene-vinyl acetate copolymers, ion-crosslinked olefin copolymers (ionomers), styrene-butadiene block copolymers, polycarbonates, vinyl chloride-vinyl acetate copolymers, cellulose esters and polyimides, and thermosetting binders such as epoxy resins, urethane resins, silicone resins, phenolic resins, melamine resins, xylene resins, thermosetting acrylic resins, unsaturated polyester resins, bismaleimide resins and alkyd resins, though applicable binders are not limited to those exemplified above. It is preferred that the volume resistivity of such electrically insulating resin be at least $1\times10^{14}$ Ω-cm as measured singly.

In the present invention, it is preferred that the nitrophthalic anhydride is used in an amount of 1 to 200 parts by weight, especially 10 to 150 parts by weight, per 100 parts by weight of the phthalocyanine type photoconductor. If the amount of the nitrophthalic anhydride is too large and is beyond the above range, the initial surface potential of the photosensitive layer is apt to decrease, and if the amount of the nitrophthalic anhydride is too small and is below the above range, the sensitivity becomes insufficient. From the viewpoint of the electrophotographic characteristic or the mechanical characteristic of the photosensitive layer, it is preferred that the phthalocyanine type photoconductor and the electrically insulating resin be used at a weight ratio based on solids of from 1/20 to 1/1, especially from 1/10 to 1/2.

In addition to the foregoing three indispensable ingredients, known additives may optionally be incorporated into the photosensitive composition of the present invention. For example, there may be incorporated known thickeners, viscosity depressants, slagging-preventing agents, leveling agents, defoaming agents, dyes and sensitizers.

The photosensitive composition of the present invention is dissolved or dispersed in an organic solvent to form a coating composition, and this coating composition is coated on an electrically conductive substrate and is then dried, whereby a photosensitive plate for electrophotography is obtained.

As the organic solvent to be used for forming the coating composition, there can be mentioned, for example, aromatic hydrocarbons such as benzene, toluene and xylene, cyclic ethers such as dioxane and tetrahydrofuran, ketones such as methylethyl ketone, methylisobutyl ketone and cyclohexanone, alcohols such as diacetone alcohol, ethylene glycol and isobutyl ether, and aliphatic hydrocarbons such as cyclohexane. These organic solvents may be used singly or in the form a mixture of two or more of them. Since the nitrophthalic anhydride that is used in the present invention is easily soluble in these organic solvents, a homogeneous coating composition can be prepared. Preparation of the coating composition can be accomplished very easily by dispersing a phthalocyanine type photoconductor in a resin solution and dissolving a nitrophthalic anhydride in the dispersion. From the viewpoint of the adaptability to the coating operation, it is preferred that the so-prepared coating composition should have a solid concentration of 1 to 50%, especially 5 to 30%.

As the electrically conductive substrate, a foil or plate of copper, aluminum, silver, tin or iron may be used in the form of a sheet or drum. Moreover, there may be used an electrically conductive substrate formed by thinly applying such metal on a plastic film or the like by vacuum evaporation deposition or non-electrode plating.

The photosensitive composition of the present invention may ordinarily be applied to the above-mentioned substrate in the form of a layer having a thickness of 2 to 20 μm, especially 3 to 10 μm, as solids.

As described hereinbefore, the photosensitive composition of the present invention has an excellent sensitivity and also has a good memory resistance when subjected to exposure repeatedly. Accordingly, the photosensitive composition of the present invention can be used widely for various electrophotographic photosensitive plates, especially photosensitive plates for high speed reproduction and photosensitive plates for laser printing.

The present invention will now be described in detail with reference to the following Examples that by no means limit the scope of the present invention.

EXAMPLE 1

A metal-free phthalocyanine (Heliogen Blue 7800 supplied by BASF AG.), 4-nitrophthalic anhydride and a polyester resin (Bylon RV-200 supplied by Toyobo Co.) were mixed at a weight ratio of 3:1:18 in tetrahydrofuran, and the mixture was kneaded in a ball mill for 24 hours. The resulting coating composition was coated on an aluminum plate having a thickness of 80 μm by a wire bar and dried at 100° C. for 30 minutes to form a photosensitive layer having a thickness of 10 μm.

EXAMPLE 2

A photosensitive layer was formed in the same manner as described in Example 1 except that 3-nitrophthalic anhydride was used instead of the 4-nitrophthalic anhydride used in Example 1.

EXAMPLE 3

A photosensitive layer was formed in the same manner as described in Example 1 except that 3,5-dinitrophthalic anhydride was used instead of the 4-nitrophthalic anhydride used in Example 1.

EXAMPLE 4

A photosensitive layer was formed in the same manner as described in Example 1 except that 3,6-dinitrophthalic anhydride was used instead of the 4-nitrophthalic anhydride used in Example 1.

COMPARATIVE EXAMPLE 1

A photosensitive layer was formed in the same manner as described in Example 1 except that the 4-nitrophthalic anhydride used in Example 1 was not added.

COMPARATIVE EXAMPLE 2

A photosensitive layer was formed in the same manner as described in Example 1 except that 2,4,7-trinitro-9-fluorenone was used instead of the 4-nitrophthalic anhydride used in Example 1.

COMPARATIVE EXAMPLE 3

A photosensitive layer was formed in the same manner as described in Example 1 except that chloranil was used instead of the 4-nitrophthalic anhydride used in Example 1.

COMPARATIVE EXAMPLE 4

A photosensitive layer was formed in the same manner as described in Example 1 except that phthalic anhydride was used instead of the 4-nitrophthalic anhydride used in Example 1.

COMPARATIVE EXAMPLE 5

A photosensitive layer was formed in the same manner as described in Example 1 except that 4-nitrophthalic acid was used instead of the 4-nitrophthalic anhydride used in Example 1.

The charge decay characteristics of the foregoing photosensitive layers were measured by using an electrostatic paper analyzer supplied by Kawaguchi Denki K. K. according to the procedures shown in FIG. 1 under the following conditions.

Measurement mode: static measurement mode II.
Applied voltage: +6 Kvolt.
Exposure quantity: 40 luxes (tungsten light source).
Surface potential: volt.
Sensitivity: t×40 (lux.sec).

The obtained results are shown in Table 1.

TABLE 1

| | Surface Potential (volt) | Sensitivity (lux · sec) |
|---|---|---|
| Example 1 | 800 | 11.2 |
| Example 2 | 864 | 18.0 |
| Example 3 | 821 | 16.5 |
| Example 4 | 840 | 19.3 |
| Comparative Example 1 | 928 | 64.0 |
| Comparative Example 2 | 854 | 26.2 |
| Comparative Example 3 | 800 | 34.2 |
| Comparative Example 4 | 1008 | 60.3 |
| Comparative Example 5 | 902 | 58.0 |

What is claimed is:

1. A photosensitive composition for electrophotography which consists essentially of (A) a phthalocyanine photoconductor, (B) 4-nitrophthalic anhydride as a sensitizer, and (C) an electrically insulating, electrophotographically inactive resin binder having a volume resistivity of at least $1\times10^{14}$ Ω-cm, the sensitizer (B) being present in an amount of 1 to 200 parts by weight per 100 parts by weight of the photoconductor (A), and the photoconductor (A) and the binder (C) being present at a weight ratio of from 1/20 to 1/1.

2. A composition as set forth in claim 1 wherein the sensitizer (B) is present in an amount of 10 to 150 parts by weight, per 100 parts by weight of the photoconductor (A), and the photoconductor (A) and the binder (C) are present at a weight ratio of from 1/10 to 1/2..

3. A composition as set forth in claim 1 wherein the phthalocyanine photoconductor is a metal-free phthalocyanine or its nucleus-substituted derivative.

* * * * *